United States Patent [19]

Parks et al.

[11] Patent Number: 4,928,505

[45] Date of Patent: May 29, 1990

[54] POWERED PORTABLE WRINGER

[75] Inventors: Lee R. Parks, 2520 Lodi La., San Jose, Calif. 95124; Wiley A. Kittrell, Milpitas, Calif.

[73] Assignee: Lee R. Parks, San Jose, Calif.

[21] Appl. No.: 907,846

[22] Filed: Sep. 15, 1986

[51] Int. Cl.[5] ..... D06F 45/18

[52] U.S. Cl. ..... 68/253 R; 68/269 R; 29/115; 100/172

[58] Field of Search ..... 68/253 C, 269 R, 269 C; 100/155 P, 172, 157; 29/115

[56] References Cited

U.S. PATENT DOCUMENTS

| | | | |
|---|---|---|---|
| 1,466,914 | 9/1923 | Meves | 68/253 R |
| 1,508,602 | 9/1924 | Jones | 68/269 R |
| 1,626,831 | 5/1927 | Howe | 68/253 R |
| 1,761,030 | 6/1930 | Zwiebel | 68/249 |
| 2,395,915 | 3/1946 | Specht | 29/115 X |
| 2,815,653 | 12/1957 | Etten | 68/269 R |
| 2,950,507 | 8/1960 | Keyser | 29/115 X |
| 3,132,581 | 5/1964 | Isbey et al. | 100/172 X |
| 4,013,166 | 3/1977 | Weady et al. | 29/115 |

*Primary Examiner*—Frankie L. Stinson

[57] ABSTRACT

A wringer for squeezing liquid from a wet cloth comprising:

a housing formed to support a first roller and a second roller;

with the first roller being formed as a hollow cylinder and having an electric motor disposed therewithin for providing rotational power to the first roller;

a power communication arrangement formed within the first roller and the housing, and disposed to communicate rotational power from the electric motor to the second roller; the power communication arrangement functioning such that if one of the first or second rollers is held in fixed position the other of the first or second rollers will continue to rotate through power supplied by the electric motor.

5 Claims, 4 Drawing Sheets

POWERED PORTABLE WRINGER

BACKGROUND OF THE INVENTION

1. Field of the Invention

The present invention relates to a wringer for squeezing liquid from a cloth and more particularly to a portable, motor driven wringer.

2. Description of the Prior Art

Wringers that utilize two rollers to squeeze liquid from a cloth have been known for decades. Early versions utilized a hand crank and a gearing mechanism to provide power to the two rollers, such that they rotated in opposite directions and drew a wet cloth therethrough. A spring mechanism was employed to pressure the rollers together. One example of such a device is presented in U.S. Pat. No. 39,864, entitled Wringer, issued Sept. 8, 1863 to C. H. Packard. One of the two rollers of Packard resides in a curved slot having a radius of curvature centered on the shaft of the gear that drives the roller; thus keeping the gears enmeshed while allowing the spacing between the rollers to change. Other patents of interest are U.S. Pats. No. 278,966; 345,952; 356,641 and 599,431.

Thereafter, motors were utilized to drive the rollers, in replacement of the hand crank. A recent example of such a device is U.S. Pat. No. 4,554,806, entitled Motor Driven Mini-Wringer, issued Nov. 26, 1985 to Doris J. Hewins. In this device an electric motor, located above the rollers, is directly geared to one of the two rollers. The other roller is held in close proximity to the powered roller by a spring mechanism, and a wet rag is drawn through the rollers by the action of the powered roller.

Other prior art related to motorized rollers is shown in U.S. Pat. No. 4,082,180, entitled Motorized Conveyor Pulley, issued Apr. 4, 1978 to Jackson Chung. This invention relates to a conveyor pulley or roller which contains a motor therewithin. The housing of the motor is fixed and non-rotatable, and the rotating drive shaft of the motor is connected to the outer housing of the roller. Activation of the motor thus drives the roller in rotation. Another powered roller patent of interest is U.S. Pat. No. 4,013,166, entitled Hydraulic Driven Pulley For COnveyors, issued Mar. 22, 1977 to Andrew A. Wendy et al.

SUMMARY OF THE INVENTION

It is an object of the present invention to provide a motorized wringer for removing liquid from a cloth.

It is another object of the present invention to provide a portable mortorized wringer which is compact and easy to use.

It is a further object of the present invention to provide a portable, motorized wringer having two powered rollers and a motor disposed within one of the rollers which is safe and easy to use.

The present invention is a motorized wringer including two rollers that are held in close proximity by a spring mechanism. One of the rollers contains an electrical motor therewithin and batteries for powering the motor. The motor housing is connected to the roller that encases it, and the motor drive shaft is connected to gears that drive the second roller.

It is advantage of the present invention that it provides a compact portable wringer device.

It is another advantage of the present that it provides a motorized wringer which is simple and safe to use.

The foregoing and other objects, features and advantages of the invention will be apparent from the following detailed description of the preferred embodiment which make reference to the drawing.

IN THE DRAWINGS

DESCRIPTION OF THE PREFERRED EMBODIMENT

Figure 1:
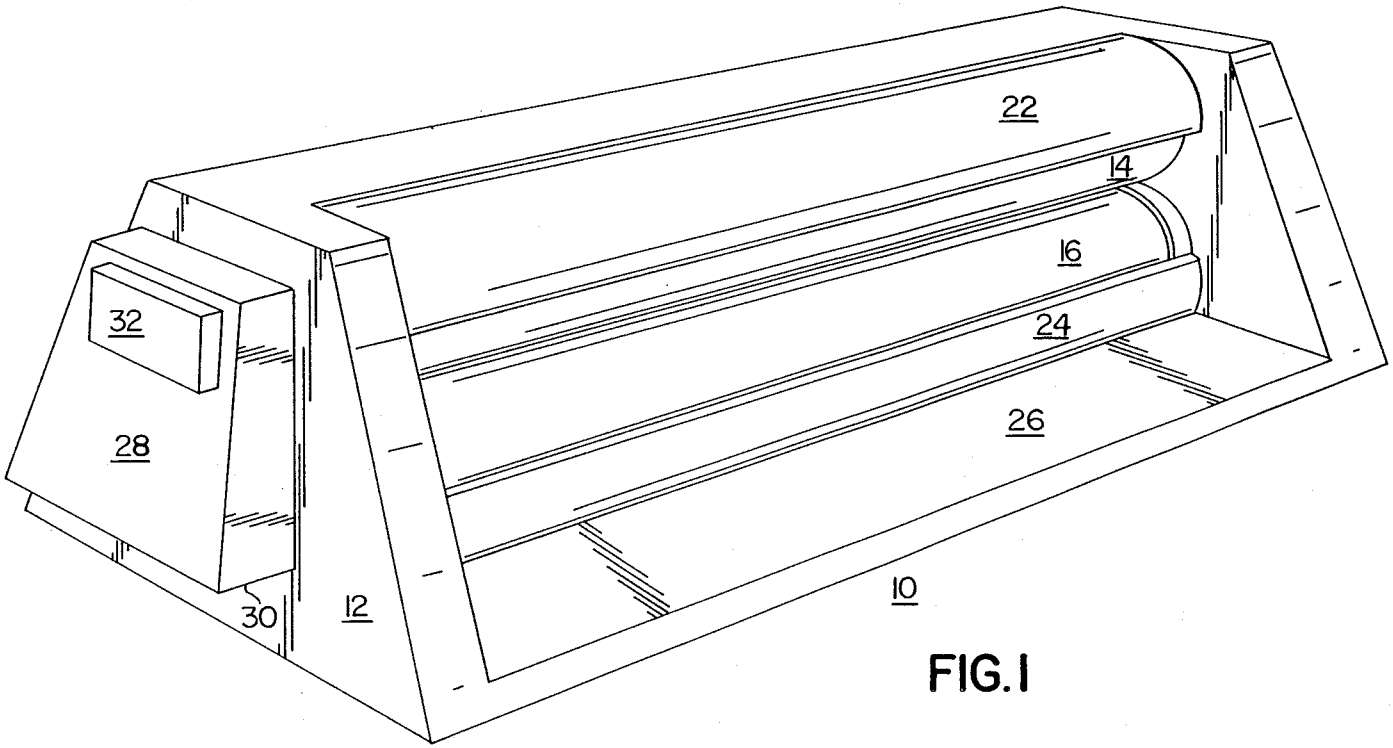
FIG. 1 is a perspective view of the present invention.

A perspective view of the preferred embodiment of the present invention is shown in FIG. 1. The invention 10 has a housing 12 which supports and substantially encloses an upper roller 14 and a lower roller 16. The rollers 14 and 16 may be smooth but preferably have fluted surfaces to provide a good gripping action for a wet rag which passes between the rollers 14 and 16 upon operation of the device 10. The housing 12 is formed with curved roller guards 22 and 24 and a water runoff platform 26. Holes (not shown) may be formed in the bottom of the housing 12 to facilitate water removal from the device. The housing 12 may be constructed with a removable facing portion which permits the user to gain easy access to the inner portions of the device 10 in order to clear any jammed cloths and serves as a safety feature as is described more fully hereinafter. The housing 12 is formed with laterally extending ears 28 having a lower surface 30 for resting upon the edge of a bucket or sink. The preferred embodiment of device 10 is designed to be a portable wringer that is positioned above a bucket when used. Thus the total lateral dimension of the device between the ears is approximately 14.5 inches, of which each of the ears 28 protrudes approximately one inch from the side of the body 12. The device is therefore configured to sit upon a standard two to five gallon bucket having a diameter of approximately 13 inches. Of course, the invention is in no way limited to these dimensions and other configurations are clearly within the scope of the invention. An electrical switch 32 is provided for operation by the user to activate the electrical motor within the device as is described more fully hereinafter. The switch 32 may be located on the upper surface of the housing 12 or on the ear portion 28 (as shown in FIG. 1) or any other convenient location.

Figure 2:
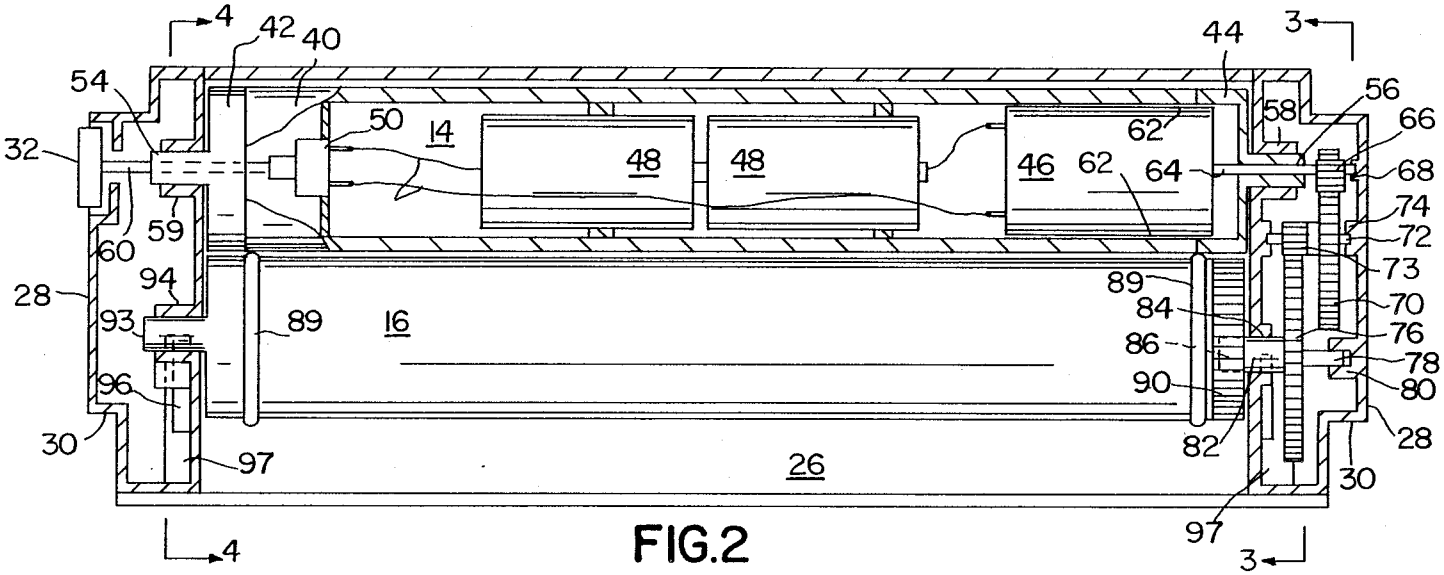
FIG. 2 is a front elevational view of the present invention having cutaway portions.

FIG. 2 depicts a cutaway front elevational view of the invention. As depicted in FIG. 2, upper roller 14 is shown with its outer surface cut away. Roller 14 is formed as a hollow cylinder having a cylindrical surface 40 that is capped on each end by end cap members 42 and 44. Disposed within the cylindrical cavity of roller 14 are a motor 46 and batteries 48, two of which are shown, and a electrical switch 50. Electrical wires 52 connect the motor 46, batteries 48 and switch 50 in a conventional manner. Each end cap 42 and 44 is solidly joined to a protruding hollow bearing shaft 54 and 56 respectively. Shaft 56 is journaled in a bearing 58 that is joined to the housing 12, such that the roller 14 is free to rotate within the bearing 58. Likewise, shaft 54 is journaled in a bearing 59 that is joined to the housing 12, to permit roller 14 to freely rotate within the housing 12. A switch activating rod 60 is disposed to pass laterally through the hollow core of shaft 54 between the button 32 and the switch 50. Activation of the button 32 by depressing it laterally thus causes the switch rod 60 to depress a mechanism within electrical switch 50 to connect the wiring circuit 52, whereby the motor 46 is activated by power from the batteries 48. Clearly other methods of making the electrical connection could be utilized, and such methods are within the scope of the invention described herein. As a safety feature, in the preferred embodiment the switch 50 is designed such that when button 32 is not depressed the motor 46 is deactivated.

In the preferred embodiment, switch 50 is adapted to also function as a battery recharging component. In this configuration, button 32 together with rod 60 is removed from the device 10 and an electrical jack (not shown), connected externally to a recharging transformer, is configured to be inserted thru the hollow shaft 54 and into the battery recharging elements of switch 50. Thus the batteries 48 within roller 14 can be recharged when the device is not in use.

The outer casing 62 of the motor 46 is joined to the inner surface of the roller cylinder 40. Thus the motor casing 62 rotates along with the roller 14. The drive shaft 64 of the motor 46 protrudes through the hollow bearing shaft 56. A small gear 66 is mounted on the drive shaft 64 in position to drive further gears described hereinafter, and drive shaft 64 is journaled in a bearing 68 mounted to housing 12.

An intermediate reduction gear 70 is journaled within the housing 12 to reduce the rotational speed of the motor 46 and transmit the rotational power of motor 46 to the lower roller 16. The reduction gear 70 is mounted on a shaft 72 that is journaled in bearings 74 for support. A reduced diameter gear 73 portion of reduction gear 70 is disposed to mesh with a second reduction gear 76. The second reduction gear 76 is journaled within the housing 12 to further reduce the rotational speed and thereby increase rotational power that is transmitted from the motor 46 to the lower roller 16. Reduction gear 76 is mounted on a shaft 78 which is journaled in a bearing 80 joined to the housing 12 for support. The reduced diameter portion 82 of reduction gear 76 is journaled within a bearing 84 joined to the housing 12 for support. An extended geared portion 86 of gear 76 is disposed to mesh with a toothed gear portion 90 formed in the lower roller 16. It is therefore to be realized that power from the drive shaft 64 of motor 46 is communicated and multiplied through the enmeshed gearing mechanism of gears 66, 70, 73, 76, 86, 90. It is to be understood that other mechanisms utilizing a greater or fewer number of gears is within the contemplation and scope of the invention.

Lower roller 16 is formed as a hollow cylinder of substantially the same diameter as upper roller 14. Each end of roller 16 is formed with an end cap member 90 and 91. Each end cap 90 and 91 is joined to a bearing shaft 92 and 93 respectively, each of which is journaled in a curved, slotted bearing 94 formed in the housing 12 to permit rotation of the lower roller 16. For clarity of understanding, bearing shaft 92 and its associated slotted bearing 94 are not depicted in FIG. 2 at end 90 of roller 16. An O-ring 89 is positioned on each end of the lower roller 16 proximate the end caps 90 and 91. Each O-ring 89 has sufficient thickness and resiliency to make contact with the upper roller 14 to act as a water guard and prevent squeezed water from entering the bearing and gear mechanism within the housing.

Figure 3:
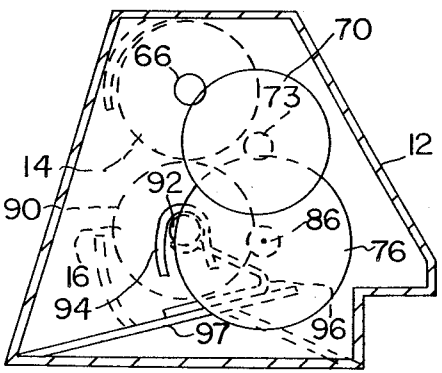
FIG. 3 is a sectional end view of the invention taken along lines 3—3 of FIG. 2 having cutaway portions.

FIG. 3 is a side elevational view of the invention taken along lines 3—3 of FIG. 2 having partially cutaway portions. FIG. 3 depicts the relative positioning of the gearing mechanism described hereinabove. It is seen in FIG. 3 that gear 66 interacts with gear 70 which communicates through gear 73 with gear 76 to cause gear 86 to interact with gear 90 of the lower roller 16.

Figure 4:
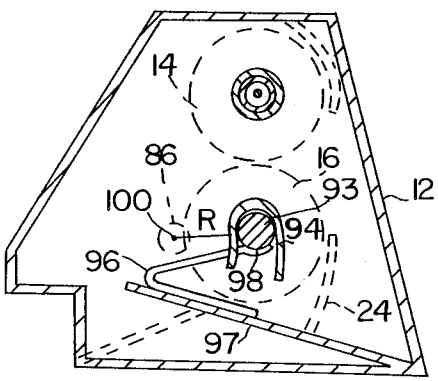
FIG. 4 is a sectional end view of the present invention taken along lines 4—4 of FIG. 2 having cutaway portions.

FIG. 4 depicts a side elevational view of the device taken along lines 4—4 of FIG. 2 having partially cutaway portions. As depicted in FIG. 4, the bearing shaft 93 of roller 16 is journaled within a slotted bearing 94 formed in the housing 12. A spring mechanism, shown in FIG. 4 as a leaf spring 96, is positioned upon a support structure 97 formed in the housing 12 to apply an upward force by interacting with the lower portion 98 of shaft 93, to force roller 16 in an upward direction proximate the upper roller 14. The slotted bearing 94 is formed with a radius of curvature R that is centered at point 100. Referring also to FIG. 3, it is seen that point 100 is the center of gear 86 which interacts with the gear 90 of roller 16. It is therefore to be realized that gear 90 will remain fully enmeshed with gear 86 while roller 16 is free to move within the slotted bearing 94. The lower roller guard 24 is curved away from roller 16 to permit the downward movement of roller 16 within the slotted bearing 94. It is to be understood from FIG. 3 that bearing shaft 92 on the other end of roller 16 is supported by a spring mechanism 96 and is mounted in a slotted bearing 94 that are disposed and function in a similar manner as do spring 96 and slotted bearing 94, as is described herein.

Figure 5:
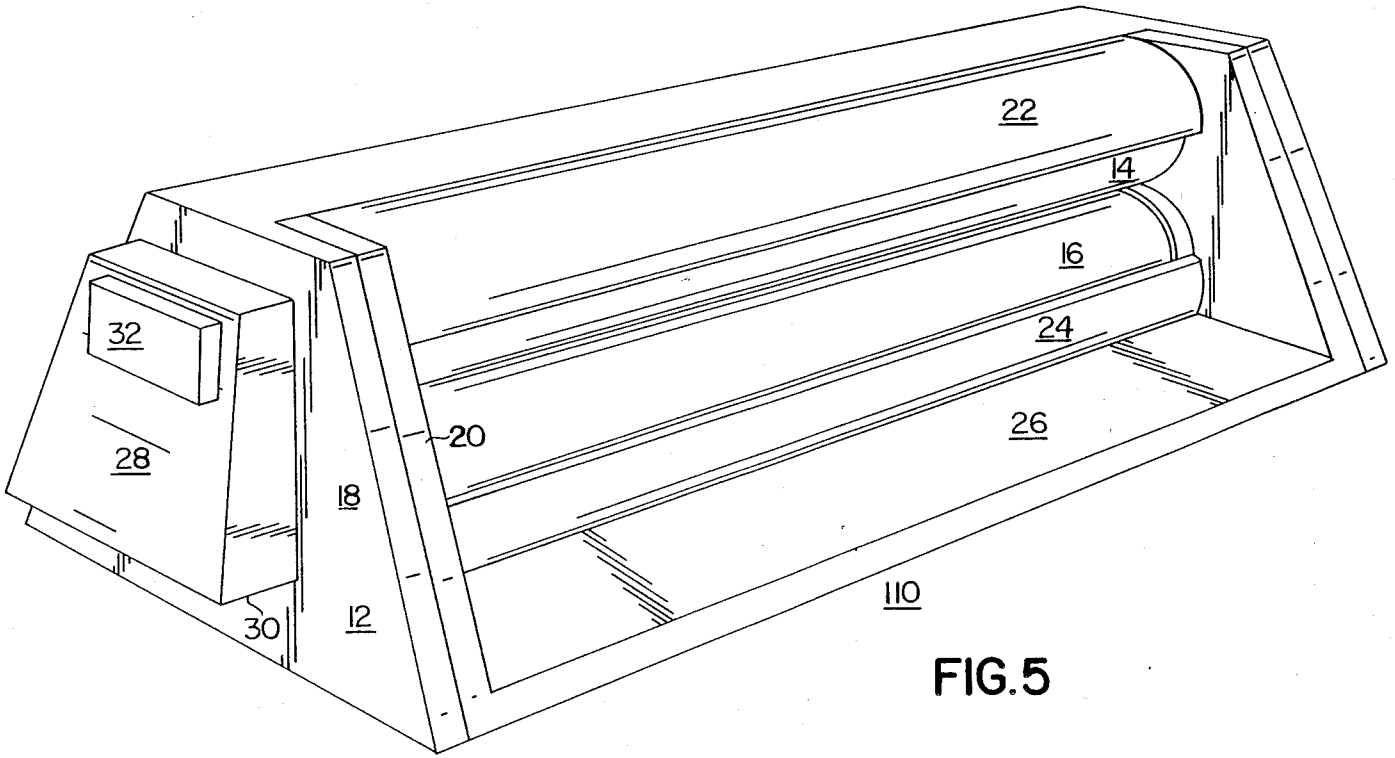
FIG. 5 is a perspective view of an alternative embodiment of the present invention.

FIG. 5 depicts an alternative embodiment 110 of the present invention having a removable front facing as an additional safety feature. The identical components of embodiments 10 (see FIG. 1) and 110 are numbered identically and function identically. However, in FIG. 5, the housing 12 consists of a body portion 18 and front facing portion 20 as is described more fully hereinafter, upon removal of the front facing portion 20, the roller guards 22 and 24 together with the water run-off platform 26 and the lower roller 16 will be removed. Thus removal of the front facing portion 20 will permit the user to gain easy access to inner portions of the device in order to clear any jammed cloths and serves as a safety feature.

Figure 6:
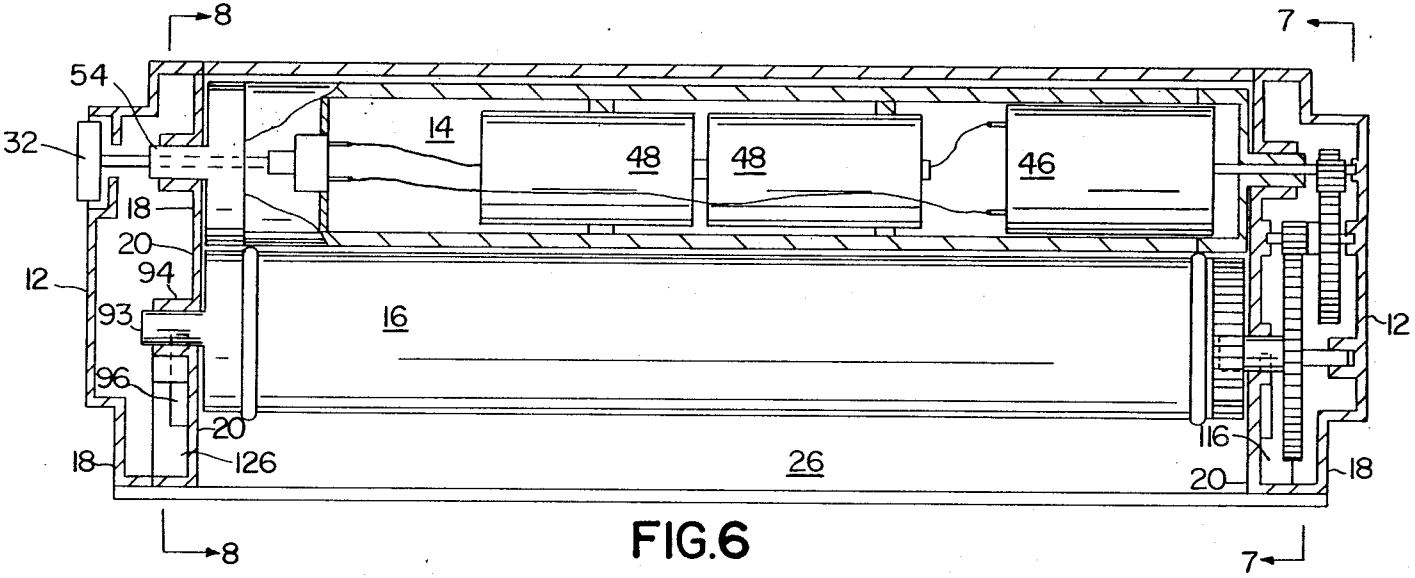
FIG. 6 is a front elevational view of the invention depicted in FIG. 5 having cutaway portions.

FIG. 6 is a front elevational view of the device depicted in FIG. 5 having cut-away portions. The embodiment depicted in FIG. 6 is therefore quite similar to the embodiment depicted in FIG. 2 and the major components have been identically numbered. In FIG. 6 it is seen that the housing 12 consists of a body portion 18 and the removable front facing portion 20 which includes the slotted bearing 94 that holds bearing shaft 93 of roller 16. As with FIG. 2, bearing shaft 92 of roller 16 and its associated slotted bearing 94 are not shown in FIG. 6 in order that the gearing arrangement could be more clearly depicted.

Figure 7:
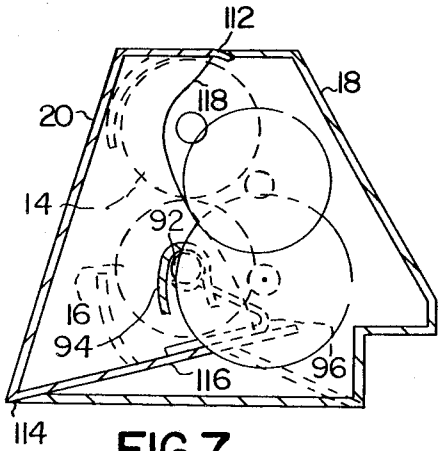
FIG. 7 is a sectional end view of the invention depicted in FIG. 6 taken along lines 7—7 of FIG. 6 having cutaway portions.

FIG. 7 is a side elevational view of the embodiment depicted in FIG. 6 taken along lines 7—7 of FIG. 6 having partially cut-away portions. FIG. 7 is therefore similar to FIG. 3 and several identical components are identically numbered. As can be seen in FIG. 7, the facing 20 joins the body 18 at a joint 112 along the upper surface of the embodiment 110, and also at an edge joint 114 along the front edge of the embodiment 110. A spring support structure 116, which supports spring 96, is an integral part of the facing 20. The facing 20 abuts the body 18 along the linear joint 118. It is therefore to be realized that the slotted bearing 94 is also an integral part of facing 20. Thus, upon removal of the facing 20, the support structure 116, the spring 96, the slotted bearing 94 and the lower roller 16 will be removed.

Figure 8:
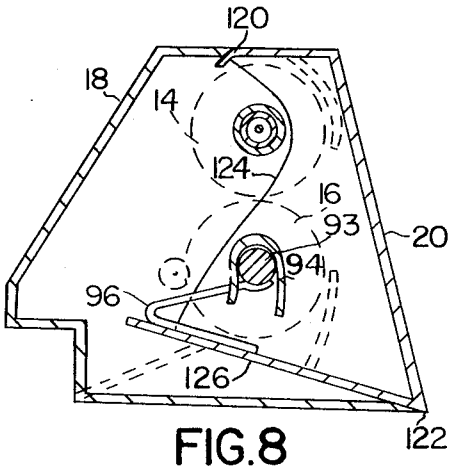
FIG. 8 is a sectional end view of the invention depicted in FIG. 6 taken along lines 8—8 of FIG. 6 having cutaway portions.

FIG. 8 depicts a side elevational view of the embodiment 110 taken along lines 8—8 of FIG. 6, having partially cut-away portions. FIG. 8 is similar to FIG. 4 and the major components thereof are numbered identically. As shown in FIG. 8, facing 20 is joined to the body 18 at an upper joint seam 120 and at a lower corner joint 122. The linear seam joint 124 separates the facing 20 from the body 18. The spring support structure 126 and the slotted bearing 94 are integral parts of the facing 20. It is therefore seen that upon removal of the facing 20 that the spring support 126, the spring 96, the slotted bearing 94 and the shaft 93 of roller 16 will be removed. This structure accomplishes an important safety feature of the present invention in that any cloth or foreign object which becomes jammed between the rollers is easily freed upon removal of the front plate 20 and the attached lower roller 16.

While the invention has been particularly shown and described with reference to certain preferred embodiments, it will be understood by those skilled in the art that various alterations and modifications in form and detail may be made therein. Accordingly it is intended that the following claims cover all such alterations and modifications as fall within the true spirit and scope of the invention.

We claim:

1. A wringer for squeezing liquid from a wet cloth comprising:

a housing formed to support a first roller and a second roller;

said first roller being formed as a hollow cylinder and having an electric motor disposed therewithin for providing rotational power to said first roller; said first roller also having a means for providing electrical energy to said motor;

a power communication means formed within said first roller and said housing, and disposed to communicate rotational power from said electric motor to said second roller; said power communication means functioning such that if one of said first or second rollers is held in fixed position the other of said rollers will continue to rotate through power supplied by said electric motor;

resilient means formed within said housing and disposed to urge said first and second rollers proximate each other;

whereby said rollers will rotate in opposite directions upon activation of said electric motor and simultaneously squeeze and draw a wet cloth through said rollers.

2. A wringer as claimed in claim 1 wherein said housing is formed from two releasably engagable portions and said first roller is rotatably engaged within one of said portions and said second roller is rotatably engaged within the other of said portions.

3. A wringer for squeezing liquid from a wet cloth comprising:

a housing formed to support a first roller and a second roller;

said first roller being formed as a hollow cylinder and having an electric motor disposed therewithin for providing rotational power to said first and second rollers; said first roller also having a means for providing electrical energy to said motor; and wherein the casing of said electric motor is fixedly engaged to said first roller such that said casing rotates along with said first roller;

a power communication means formed within said first roller and said housing, and disposed to communicate rotational power from said electric motor to said second roller;

resilient means formed within said housing and disposed to urge said first and second rollers proximate each other;

whereby said rollers will rotate in opposite directions upon activation of said electric motor and simultaneously squeeze and draw a wet cloth through said rollers.

4. A wringer as described in claim 3 wherein said first roller is supported within said housing by at least one hollow support bearing, and wherein said power communication means includes a drive shaft, which protrudes from said electric motor through said hollow support bearing, and a gear means, which is disposed within said housing and rotatably engaged with said drive shaft and said second roller.

5. A wringer as described in claim 3 wherein said housing is formed from two releasably engageable portions and said first roller is rotatably engaged within one of said portions and said second roller is rotatably engaged within the other of said portions.

* * * * *